US005733377A

United States Patent [19]

Howe

[11] Patent Number: 5,733,377

[45] Date of Patent: Mar. 31, 1998

[54] METHOD FOR CLEANING AN AUTOMOTIVE OR TRUCK WHEEL SURFACE

[75] Inventor: Michael Howe, Mission Viejo, Calif.

[73] Assignee: Armor All Products Corporation, Aliso Viejo, Calif.

[21] Appl. No.: 463,020

[22] Filed: Jun. 5, 1995

Related U.S. Application Data

[62] Division of Ser. No. 413,926, Mar. 29, 1995, Pat. No. 5,556,833, which is a continuation of Ser. No. 166,185, Dec. 10, 1993, abandoned.

[51] Int. Cl.[6] ..... B08B 3/08; C11D 3/04; C11D 7/04; C11D 7/50

[52] U.S. Cl. ..... 134/3; 134/41; 134/28; 134/38; 134/40; 510/189; 252/79.3; 252/79.4

[58] Field of Search ..... 134/2, 3, 28, 38, 134/40, 41; 252/79.3, 79.4, 142, 162, 170, 173; 510/189

[56] References Cited

U.S. PATENT DOCUMENTS

| | | | |
|---|---|---|---|
| 3,969,135 | 7/1976 | King et al. | 134/41 |
| 4,181,623 | 1/1980 | Dillarstone et al. | 252/143 |
| 4,346,128 | 8/1982 | Loch | 427/328 |
| 4,472,205 | 9/1984 | Cortner | 134/27 |
| 4,532,065 | 7/1985 | Cohen et al. | 252/135 |
| 4,614,607 | 9/1986 | Loch | 252/142 |
| 4,738,876 | 4/1988 | George et al. | 427/299 |
| 5,156,687 | 10/1992 | Ushio et al. | 134/40 |
| 5,164,018 | 11/1992 | Barcelona, Jr. | 134/28 |

FOREIGN PATENT DOCUMENTS

| | | |
|---|---|---|
| 1179860 | 2/1970 | United Kingdom . |

*Primary Examiner*—Zeinab El-Arini
*Attorney, Agent, or Firm*—Flehr Hohbach Test Albritton & Herbert LLP

[57] ABSTRACT

A method for cleaning automotive or truck wheel surfaces. A cleaning composition containing an acid fluoride salt and having a pH of about 3 to 6.5 is applied to the automotive or truck wheel surface. The cleaning composition contains soluble salt in an amount which provides the composition with a molar ratio of soluble anion to hydrogen ion of about 3.5 or greater. This protects the wheel surfaces cleaned, including those of untreated aluminum, from corrosive attack by the acid fluoride salt.

7 Claims, No Drawings

METHOD FOR CLEANING AN AUTOMOTIVE OR TRUCK WHEEL SURFACE

This application is a division application of U.S. Ser. No. 08/413,926, filed Mar. 29, 1995, now U.S. Pat. No. 5,556,833, which is a continuation of Ser. No. 08/166,185, filed Dec. 10, 1993, abandoned.

FIELD OF THE INVENTION

This invention relates to a cleaning composition suitable for use on automotive and truck wheels.

BACKGROUND OF THE INVENTION

Various cleaning compositions have been used for cleaning automotive wheels. Detergent formulations have been commercialized for such usage, but they have the disadvantage of requiring much scrubbing and hard work to remove the soils adhered to the wheels. Generally such formulations are only partially effective.

Acid cleaners replaced detergent formulations as the cleaning composition of choice for wheels. These cleaners usually consist of strong acids such as phosphoric, hydrochloric, sulfuric, oxalic, acetic, hydroxyacetic, hydrofluoric, and citric acids, as well as blends of the various acids. These products are not very effective in removing road soils from wheels. They have the additional disadvantage in that they are highly corrosive to wheels, paints and plastics and tend to strip paint and chrome and discolor aluminum and chrome. These products often require neutralization steps with strongly alkaline solutions which can also cause corrosion and pitting.

Another type of wheel cleaner is based on alkaline hard surface cleaners. These formulas consist mainly of detergents, water soluble organic solvents such as glycol ether, and alkaline materials such as sodium hydroxide, potassium hydroxide, and/or any of the alkaline silicates and phosphates. The disadvantages of these products are that they are not very effective at cleaning wheel soils, and the highly alkaline nature can damage painted and aluminum surfaces. Also, if they are allowed to dry on the surface, they tend to leave insoluble residues.

Outside of the automotive care industry, various other types of cleaning formulations have been devised for use on metal surfaces and industrial machinery. However, such compositions generally have to be use at elevated temperatures and typically work by etching the surface that is cleaned. For example, U.S. Pat. No. 4,614,607 describes a gelled deoxidizer comprising an aqueous solution of nitric acid, sulfuric acid, ammonium bifluoride, and fumed silica which cleans aluminum by way of a constant etching rate.

U.S. Pat. No. 3,969,135 discloses the use of ammonium fluoride in cleaning compositions for removing residues on aluminum surfaces which remain after the production of the metal. To be effective, the cleaning composition is used at elevated temperatures, around 120° F.

British patent No. 1,179,860 discloses an aqueous alkaline cleaning solution for use on galvanized metals. The cleaning solution comprises fluoride salts and soluble soaps in an alkaline aqueous solution. Effective cleaning occurs at elevated temperatures between 120°–160° F.

U.S. Pat. No. 4,346,128 describes a tank process for plating aluminum substrates. The process first involves a cleaning step of immersing the substrate in a low pH dilute acid bath containing an acidic fluoride-containing salt so as to remove surface contaminants from the substrate. However, this cleaning process results in some etching of the substrate.

SUMMARY OF THE INVENTION

In view of the deficiencies of the presently available cleaning compositions for automotive and truck wheels and for aluminum surfaces, it is an object of the present intention to provide a cleaning composition that safely cleans various wheel surfaces, such as those of aluminum, painted aluminum, painted steel, chrome, stainless steel, clear coated aluminum, and plastic wheel covers and hub caps, without pitting, etching, or hazing the surface cleaned.

It is a further object of the present invention to provide such a cleaning composition that is effective without the need for scrubbing.

It is a further object of the present invention that the cleaning composition be effective without the requirement of elevated temperatures.

A further objective is to provide an effective wheel cleaner which avoids the use of alkaline materials which can strip paint, cause metal pitting, and leave an insoluble residue.

These and other objects and features of the invention will become apparent to those skilled in the art from the following detailed description and appended claims.

The foregoing objects are achieved by an aqueous cleaning composition comprising at least one acid fluoride salt and at least one organic soil removing agent selected from the group consisting of detergents and organic solvents. The cleaning composition has a pH of about 3 to about 6.5 and is useful for cleaning wheel soils from surfaces of painted steel, painted aluminum, chrome, stainless steel, clear coated aluminum, and plastic. Typically, the acid fluoride salt is used in an amount of from about 1 to about 20 weight percent. When it is desired to clean uncoated aluminum surfaces, the aqueous cleaning composition preferably further comprises at least one soluble salt in an amount so that the anion to acid ratio of the cleaning composition is greater than 3.5.

Methods for cleaning automotive and truck wheels are also disclosed. The methods comprise applying a cleaning composition comprising an acid fluoride salt to the wheel surface to be cleaned, allowing the cleaning composition to be contacted with the surface for about 1 to 5 minutes, and rinsing the cleaning composition from the surface with water.

DETAILED DESCRIPTION OF THE INVENTION

Cleaning formulations for use on automotive and truck wheels must be effective at removing brake dust, road soils, and the partially oxidized organic layer which binds the soil to the wheel. However, for aesthetic reasons, the cleaning composition must be capable of cleaning the wheels without etching or pitting them.

The cleaning compositions disclosed herein are effective at cleaning wheel surfaces formed of painted steel, painted aluminum, chrome, stainless steel, clear coated aluminum, or plastic, without etching or pitting these surfaces. The cleaning compositions contain a fluoride salt or combination of fluoride salts. The fluoride salt-containing cleaning formulations of the prior art typically function by etching the surface to be cleaned, and thus are unsuitable for use on wheel surfaces.

The active ingredients in the cleaning composition are acid fluoride salts and detergents or organic solvents. As used herein, the term "acid fluoride salt" refers to a partially neutralized salt of hydrogen fluoride and other fluoride salts which when dissolved in water have a pH of less than 7. The acid fluoride salts effectively dissolve inorganic soils such as brake dust, while the detergents and/or organic solvents dissolve and emulsify the organic soils. Accordingly, as used herein, the term "organic soil removing agent" refers to detergents and/or organic solvents that are capable of dissolving and emulsifying organic soils.

Suitable acid fluoride salts include metal fluorides, such as alkali metal fluorides, and ammonium fluorides. Specific acid fluoride salts are potassium bifluoride, sodium bifluoride, ammonium fluorides, calcium fluorophosphates, ammonium bifluoride, sodium fluorosilicates, and the like. They are effective in removing inorganic soils from wheel surfaces without etching the surface when used in amounts of about 1 to about 20 percent by weight. Preferably they are used in amounts of about 5 to about 15 percent by weight. Formulations containing greater than 20 percent by weight can be prepared, however cost becomes a factor, unless the cleaning solution is prepared as a concentrate which is to be diluted prior to use. Crystallization and solubility of the acid fluoride salts and other ingredients can also be a problem in some formulations when greater than 20 percent by weight of the salt is used. The pH of the formulations is preferably between 3.0 to about 6.5. At pH below 3.0 hazing and etching of the surface which is cleaned can occur, thus damaging the wheel. Above pH 6.5 cleaning effectiveness declines.

Suitable detergents are any detergents capable of dissolving and emulsifying organic soils. Such detergents include, but are not limited to, the anionic synthetic detergents such as alkyl sulfates such as sodium lauryl sulfate, alkyl ether sulfates, and linear alkyl benzene sulfonates. Additionally, various nonionic surfactants can be used in the cleaning composition. For example, suitable nonionic surfactants include coconut diethanolamide, amine oxides, nonyl phenol ethoxylate, ethoxylated alcohols, ethoxylate propoxylated block co-polymers, and the like. Other suitable detergents include cationic quaternary ammonium surfactants and amphoterics such as cocoamphocarboxyglycerinate, cocamidopropyl betaines, lauroamphoglycerinate, or the like.

The amount of detergent used in the composition is not critical so long as it remains soluble in an aqueous solution at pH of about 3.0 to 6.5 and is capable of dissolving and emulsifying organic soils. The amount of detergent used typically depends on the type used. For example, nonionic detergents, such as amine oxides, are typically used in amounts of about 0.5 to about 32.5 weight percent. Anionic synthetic detergents are typically used in amounts of about 0.10–25 weight percent depending on the desired level of foaming.

Organic solvents which can be used in the cleaning compositions include, but are not limited to, glycols such as propylene glycol and glycol ethers, hydrocarbons, n-methyl pyrrolidone and its derivatives, ketones, lactones, and terpenes such as d-limonene. A particularly suitable organic solvent is ethylene glycol monobutyl ether, sold under the trade name Butyl Cellosolve. Such organic solvents are typically used in amounts of about 2 weight percent to about 40 weight percent. They are preferably used in amounts of about 15 to about 25 weight percent. Preferable hydrocarbon-type organic solvents are the terpenes which are hydrocarbons in essential oils, resins and other vegetable aromatic products which can act as solvents and dispersing agents. Preferred terpenes include limonene, dipentene, terpinene, and other monocyclic and bicyclic terpenes. Terpenes are typically used in amounts of less than about 8 weight percent.

Cleaning compositions containing the acid fluoride salt and detergent or organic solvent in the formulations described herein can be used to effectively clean the surfaces of most wheels, including painted steel, painted aluminum, chrome, stainless steel, clear coated aluminum, and plastic. However, for cleaning untreated aluminum surfaces it is necessary to prevent hazing of the aluminum. Hazing is the development of a hydrated aluminum oxide layer on the surface of the wheel. Certain embodiments of the present invention are effective at cleaning uncoated aluminum without causing hazing. It has been found that the ratio of anion to acid is an important variable to consider in the formulation of a cleaning solution that is to be used on untreated aluminum. This ratio is a mole ratio wherein the number of moles of anions is divided by the number of moles of the acid. For example. $H_2SO_4$ has a ratio of $(1)SO_4/2H^+$, or 0.5. $H_3PO_4$ has a ratio of $(I)PO_4/3H^+=0.33$. The present invention provides cleaning formulations that safely clean untreated aluminum with reduced hazing to no hazing wherein the molar ratio of anion to acid is about 3.5 or more. Preferably the molar ratio of anion to acid is about 4.0 or more. The anion to acid ratio of the present formulations can be increased into the desired range suitable for cleaning untreated aluminum by the addition of soluble salts. Suitable salts are any salt that is soluble enough to provide the desired amount of anions. Ammonium fluoride and ammonium acetate are examples of salts which have sufficient solubility to provide anion to acid ratios in the formulations of the present invention of greater than 4.0

The cleaning composition can contain other types of cleaning agents in addition to the fluoride acid salts and detergents or solvents. For example a scouring agent such as sodium metasilicate can be, incorporated into the formulation if used in amounts that enhance cleaning without pitting the surfaces cleaned. Typically, scouring agents are used in amounts up to about 2 weight percent. At levels much greater than this, the silicate tends to interfere with the effectiveness of the cleaner unless the fluoride source is a fluorosilicate based material.

Additionally, non-active agents can be added to enhance various properties of the cleaning composition. For example, thickening agents, such as polyacrylic acids, clay, xanthan gums, alginates, other natural gums, and the like, may be added. The purpose of these materials is to enhance the viscosity and thereby provide better cling of the cleaning composition. Cling, anti-sag, or viscosity allows the cleaning composition to stay in better contact with vertical surfaces, thereby enhancing its effectiveness.

Various emulsifiers and dispersing agents can be used such as the polyphosphate builders sodium tripolyphosphate and tetrapotassium pyrophosphate, as well as sodium citrate and other emulsifiers commonly used in the art. These are typically used at levels of about 0.1 to about 5 weight percent and may also include acid phosphates such as mono and disodium phosphate and sodium acid pyrophosphate.

Propellants may also be used so that the cleaning composition can be applied as an aerosol. Suitable propellants include compressed air, nitrogen, and the usual hydrocarbon and chlorinated fluorocarbon propellants.

Typically these formulas are made by first dissolving the acid fluoride salts since these tend to be endothermic and need time to go into solution. The surfactants are then added followed by the solvents. When insoluble solvents are used such as d-limonene, dipentene, and the like, the solvent is first blended into the surfactants then the water is added and mixed until uniform. The acid fluoride salt is then added either in a flake formulation or as a solution with enough water to solubilize the fluoride salt.

If other materials such as silicates or phosphates are used, they are typically dissolved in the water followed by the detergents and surfactants with the acid fluoride salt being added last either as the flake or as a solution. When a solution is used, just enough water is added to the flake to dissolve it.

It is important to prepare and store these formulas in plastic of the high density polyethylene, polypropylene, or polyvinylchloride types. The composition can be mixed in stainless steel but the residence time should be kept short as there is a tendency to attack the grain boundaries. Contact with glass should be avoided because it can be etched by the composition. The reaction with glass can deplete the composition of active fluoride ions.

In use, the composition can be dispensed from any of the plastic bottles and sprayers typically used, but care must be taken to avoid using metal parts in the sprayers as the metal parts can corrode and clog the spraying apparatus, and because the addition of standard corrosion inhibitors are not effective in the compositions of the present invention. Typical aerosol cans cannot be used because the composition can strip off the protective tin plate and organic coatings typically used with such cans. The successful use of an aerosol foam is most easily achieved through the use of technology commonly known in the art as "bag-in-a-can". This employs a laminated plastic bag welded to a valve assembly and the assembly inserted into a normal aerosol can. The cleaning composition is filled into the laminated plastic bag. The can is then pressurized using any of the normal gases such as compressed air, nitrogen, hydrocarbon, or chlorinated fluorocarbons. The pressurizing gas is injected between the bag and the can rather than into the bag. This method of packaging also has the benefit of being able to spray regardless of the orientation of the can. The can sprays just as well upside down as it does right side up or sideways.

In order that the invention described herein may be more fully understood, the following examples are set forth. It should be understood that these examples are for illustrative purposes only and are not to be construed as limiting the scope of the invention in any manner.

EXAMPLE 1

Preparation of wheel cleaning compositions containing acid fluoride salts and organic soil removing agents Cleaning compositions were prepared as follows.

| Composition A | |
|---|---|
| Water | q.s. |
| Sodium acid fluonde | 5.0% |
| Lauryl dimethyl amine oxide | 32.5% |
| Sodium dodecyl benzene sulfonate | 1.0% |
| Ethylene glycol monobutyl ether | 22.0% |

First the acid fluoride salt was dissolved in warm water to speed up the dissolution of the salt. When the acid fluoride salt was completely dissolved the lauryl dimethyl amine oxide was added and mixed until uniform. The sodium dodecyl benzene sulfonate was then added and mixed until uniform, followed by the addition of the ethylene glycol monobutyl ether (Butyl Cellosolve) with mixing until uniform. If a higher viscosity is desired, 0.1–1.0% of a xanthan gum can be pre-dispersed in the water prior to adding the acid fluoride salt.

| Composition B | |
|---|---|
| Water | q.s. |
| Xanthan gum | 0.25% |
| 8 mole ethoxylated alcohol | 0.50% |
| Sodium acid fluoride | 10.0% |

First, the xanthan gum was sifted into the water. With high shear mixing, the gum was dispersed and fully hydrated. The ethoxylated alcohol was then added and blended until fully dissolved. The acid fluoride salt was then dissolved into the solution.

| Composition C | |
|---|---|
| Water | q.s. |
| Metso Pentabead 20 | 1.8% |
| Sodium tripolyphosphate | 1.8% |
| Tetrapotassium pyrophosphate | 1.2% |
| Alkylnaphthalene sodium sulfonate | 0.25% |
| Linear alkylbenzene sulfonate sodium salt | 0.25% |
| Ammonium bifluoride | 10.0% |

First, the water was charged into the tank and the Metso Pentabead 20 dissolved. The sodium tripolyphosphate was dissolved in the solution followed by the tetrapotassium pyrophosphate. The alkylnaphthalene sodium sulfonate and the alkylbenzene sodium sulfonate were then added and the solution mixed until clear. The acid fluoride salt was then added and the solution was mixed until the salt was fully dissolved. Warm water was used to speed up the dissolution process.

EXAMPLE 2

Cleaning ability of various wheel cleaning compositions containing acid fluoride salts Various wheel cleaning compositions were prepared following the general procedures described in Example 1. The effectiveness of each cleaning composition was evaluated by spraying each one onto a dirty wheel so as to saturate the entire surface. The compositions were allowed to soak for 1 to 5 minutes at room temperature without any scrubbing. The wheels were then rinsed with a strong jet of water from a garden hose equipped with a nozzle. After rinsing, the wheel surfaces were visually evaluated for the removal of soil. Each cleaning composition was rated on a scale of 0 (no soil removal) to 5 (complete soil removal).

Table I lists the components of some of the formulations tested as set forth in Example 2. The cleaning ability of each formula was rated on a scale of 0 to 5 with 5 indicating excellent cleaning, and 0 indicating no cleaning.

TABLE I

| Ingredients | A | B | C | D | E | F | Ctrt 1 | Ctrl 2 | Ctrl 3 |
|---|---|---|---|---|---|---|---|---|---|
| Water | 67.0 | 63.0 | 70.0 | 45.0 | 84.8 | 84.8 | 84.0 | 70.0 | 68.0 |
| Alkyl ether sulfate | 3.0 | 3.0 | — | — | — | — | — | — | 3.0 |
| Alkyl sulfate | 3.0 | 3.0 | — | — | — | — | 3.0 | — | 3.0 |
| Nonionic | — | — | 20.0 | 20.0 | 5.0 | 5.0 | — | 5.0 | — |
| Gluconic adid | 8.0 | 8.0 | — | — | — | — | — | — | 8.0 |
| Phosphoric acid | — | — | — | — | — | — | 10.0 | — | — |
| Hydrochloric acid | — | — | — | — | — | — | 3.0 | — | — |
| Butyl Cellosolve | — | — | — | 25 | — | — | — | 25.0 | — |
| Sodium citrate | 6.0 | 6.0 | — | — | — | — | — | — | 6.0 |
| Thickener | 10.0 | 10.0 | — | — | 0.2 | 0.2 | — | — | 10 |
| Acid fluoride salt | 1.0 | 5.0 | 10.0 | 10.0 | 10.0 | 10.0 | — | — | — |
| CLEANING RATING | 2 | 4 | 5 | 5 | 5 | 5 | 0 | 1.5 | 0 |

As indicated by the cleaning ratings, formulations containing 10% acid fluoride salt were the most effective at cleaning using the procedures set forth in Example 2. Formulation B, which contained 5 weight percent acid fluoride salt was also a very effective cleaning formulation. The formulation of Control 2 is typical of wheel cleaning formulations that have only detergents and organic solvents as the active agents. Thus this formulation was ineffective at removing inorganic soils from the wheel surface and hence only had a cleaning rating of 1.5. Controls 1 and 3 are typical of that of wheel cleaning formulations that use strong acids and detergents as the active agents. These formulation were ineffective at cleaning the wheel soils when used in a cleaning procedure that does not entail scrubbing.

EXAMPLE 3

Preparation of wheel cleaning composition, which is suitable for use on uncoated aluminum, containing acid fluoride salts, organic soil removing agent Cleaning compositions were prepared using the general procedures set forth in Example 1 except that soluble salts were added to the cleaning compositions to increase the anion to acid ratio. Each cleaning composition was evaluated and rated for cleaning as described in Example 2 above. The surfaces tested were aluminum wheels having typical road soils and grime on their surfaces. After cleaning, the surfaces were evaluated for hazing of the aluminum. A scale of 0 to 5 was used with 0 indicating heavy hazing and 5 indication no hazing. Table 2 outlines the formulations evaluated and the results.

TABLE 2

| Ingredients | A | B | C | D | Ctrl 1 | Ctrl 2 |
|---|---|---|---|---|---|---|
| Water | qs | qs | qs | qs | qs | qs |
| Thickener | 0.10 | 0.30 | 0.30 | — | 0.50 | 0.50 |
| Propylene glycol | 20.0 | 10.0 | 10.0 | 20.0 | — | — |
| Ammonium fluoride | 16.33 | 25.92 | 25.92 | 32.88 | — | 6.48 |
| Acid fluoride salt | 10.0 | 10.0 | 10.0 | 10.0 | 10.0 | 10.0 |
| Boric Acid | 1.00 | — | 4.00 | — | — | — |
| Nonionic | — | 0.50 | 0.50 | — | 0.50 | 0.50 |
| d-limonene | — | 2.00 | 2.00 | — | 2.0 | 2.0 |
| CLEANING | 5 | 5 | 5 | 5 | 5 | 5 |

TABLE 2-continued

| Ingredients | A | B | C | D | Ctrl 1 | Ctrl 2 |
|---|---|---|---|---|---|---|
| HAZING | 5 | 5 | 5 | 5 | 0 | 1 |
| ANION/$H^+$ ratio | 4.5/1 | 6/1 | 6/1 | 7.1/1 | 2.0/1 | 3.0/1 |

As can be seen from Table 2, the cleaning formulation of Control #2, which had an anion/$H^+$ ratio of 3.0/1, exhibited reduced hazing when compared to the Control #1, which had an anion/$H^+$ ratio of 2.0/1. Examples A–D, which all had ratios greater than 4.0, exhibited no hazing yet had excellent cleaning properties.

What is claimed:

1. A method for cleaning an automotive or truck wheel surface comprising applying to said surface an aluminum-safe cleaning composition comprising at least one acid fluoride salt in an amount of from about 1 to about 20 weight percent and at least one soluble salt other than acid fluoride salt in an amount to protect said automotive or truck wheel surface from hazing and to provide said composition with a molar ratio of soluble anion to hydrogen ion of about 3.5 or greater, said cleaning composition having a pH of about 3 to about 6.5.

2. The method of claim 1 wherein said cleaning composition is allowed to contact said wheel surface for about 1 to about 5 minutes.

3. The method of claim 2 further comprising rinsing said cleaning composition from said wheel surface with water.

4. The method of claim 1 wherein said acid fluoride salt is used in an amount of from about 5 to about 15 weight percent.

5. The method of claim 1 wherein said acid fluoride salt is selected from the group consisting of potassium bifluoride, sodium bifluoride, calcium fluorophosphates, ammonium bifluoride, and sodium fluorosilicates.

6. The method of claim 1 wherein said cleaning composition further comprises at least one organic soil removing agent selected from the group consisting of detergents and organic solvents.

7. The method of claim 6 wherein said organic soil removing agent is an organic solvent selected from the group consisting of glycols, n-methyl pyrrolidone, and terpenes.

* * * * *